US005929404A

United States Patent [19]

Wecke et al.

[11] Patent Number: 5,929,404

[45] Date of Patent: Jul. 27, 1999

[54] SAFETY SWITCH ASSEMBLY

[75] Inventors: Rolf Wecke, Bückeburg; Joachim Ulfik, Viotho; Meinhard Gerner, Minden, all of Germany

[73] Assignee: Hans Bernstein Spezialfabrik für Schaltkontakte GmbH & Co., Porta Westfalica, Germany

[21] Appl. No.: 09/104,727

[22] Filed: Jun. 25, 1998

[30] Foreign Application Priority Data

Jun. 26, 1997 [DE] Germany ..... 297 11 163

[51] Int. Cl.[6] ..... H01H 27/00

[52] U.S. Cl. ..... 200/43.11; 200/17 R; 200/43.07; 200/61.62; 200/293

[58] Field of Search ..... 200/17 R, 43.02–43.08, 200/43.11, 43.13, 43.16, 43.17, 520, 533, 573, 318, 323, 324, 318.1, 293, 295, 303, 307; 361/679, 720, 729, 730, 732, 733, 735, 837

[56] References Cited

U.S. PATENT DOCUMENTS 4,454,392 6/1984 Rapp et al. ..... 200/61.67
4,963,706 10/1990 Mohtasham ..... 200/334
5,464,954 11/1995 Kimura et al. ..... 200/61.62
5,516,993 5/1996 Wecke et al. ..... 200/17 R
5,587,569 12/1996 Mohtasham ..... 200/17 R
5,703,339 12/1997 Rapp et al. ..... 200/17 R

*Primary Examiner*—Michael A. Friedhofer
*Attorney, Agent, or Firm*—Henry M. Feiereisen

[57] ABSTRACT

A safety switch includes a switch housing which accommodates a switch as well as mechanical and electrical and electronic components, and a head portion securable to an end face of the switch housing in several predetermined angular positions and accommodating a mechanical switching element e.g. a switching wheel which is operated by an actuator. A rigid positioning element is detachably secured to the switch housing and formed with a safety member, whereby the positioning element is adjustable between a locked position in which the safety member is positively engaged in the head portion and an idle position in which the safety member is disengaged from the head portion for allowing a rotation and re-positioning of the head portion relative to the switch housing.

13 Claims, 3 Drawing Sheets

SAFETY SWITCH ASSEMBLY

BACKGROUND OF THE INVENTION

The present invention generally relates to a safety switch assembly, and in particular to a safety switch of a type having a switch housing and a head portion attachable to an end face of the switch housing in several predetermined angular positions.

Safety switches of this type are known in many designs and are used for a wide range applications e.g. to cut the current supply when a protective cover is removed from an equipment or a machine or when equipment access doors and cabinet doors are opened. Such safety switches typically are formed with an access channel for entry of an actuator, e.g. a key, to operate the switch. The actuator may also be of a type secured to a flap, door, or lid at a predetermined distance to move together with the door, flap or the like. Common to all safety switches of this type is that they effect a shut-off when the actuator is withdrawn. The switch housing contains the switch, a plunger which operates the switch when moving in a longitudinal direction, and other suitable, electrical as well as electronic components. The head portion is attachable to the housing in different 90° rotated dispositions and accommodates a mechanical switching element, e.g. a switch wheel or cam plate, which is operated by the actuator and interacts with a locking pin which retains the switch wheel in a locked position to prevent an unintended switch operation and is forcibly released by the actuator when being introduced in to the actuator channel.

Typically, the head portion is fastened by two screws to one end face of the housing so that conventional safety switches require a loosening of the screws, when re-adjusting the head portion with respect to the switch housing. Not only is this time consuming but there is the risk that screws get lost when making the required positional adjustments of the head portion. Moreover, as the switch housing is generally made of plastic material, the contact pressure applied by the screw fasteners is rather high in the adjoining region.

SUMMARY OF THE INVENTION

It is thus an object of the present invention to provide an improved safety switch, obviating the afore-stated drawbacks.

In particular, it is an object of the present invention to provide an improved safety switch which permits securement of the head portion to the switch housing in various angular positions in a most simple manner, without use of any components that may get lost.

It is yet another object of the present invention to provide an improved safety switch which is so configured that the contact pressure applied by the screw fasteners is diminished.

These objects, and others which will become apparent hereinafter, are attained in accordance with the present invention by providing a rigid positioning element which is detachably secured to the switch housing and formed with a safety member, with the positioning element being adjustable between a locked position in which the safety member is positively engaged in the head portion and an idle position in which the safety member is disengaged from the head portion for allowing a positional adjustment of the head portion relative to the switch housing.

The positioning element is made of a rigid material, preferably of steel and so dimensioned that the contact pressure applied by the screw fasteners is distributed over the entire contact area between the switch housing and the positioning element. A positioning of the head portion in dependence on the fitting position of the safety switch does not require a detachment of fasteners that secure the head portion to the switch housing. It is only necessary to detach the positioning element from the switch housing to enable a disengagement of the switch housing from the head portion so that the head portion can now be turned or readjusted. The positive engagement between the safety member and the head portion in operating state of the safety switch precisely defines the respective position of the head portion with respect to the switch housing.

According to another feature of the present invention, the switch housing has a guide element for guiding the positioning element during a displacement in radial direction with respect to the longitudinal axis of the switch housing. As the guide element is fixedly mounted to the switch housing or formed integrally therewith, the positioning element can solely be displaced in a radial direction so that the safety member can be disengaged from the head portion. The guide element and the positioning element are so designed that a separation is impossible so that the positioning element is captivated by the switch housing and cannot get lost.

Suitably, the locking pin for engagement in the switch wheel contained in the head portion, has a longitudinal axis which coincides with the central longitudinal axis of the switch housing.

According to yet another feature of the present invention, the positioning element includes threaded bores for attachment to the switch housing. Thus, by using at least one screw fastener bolted into the wall of the switch housing, the positioning element can be fixed in place. Preferably, the guide element is designed as angle mounted to or formed on the switch housing and having a shank for engagement in a complementary opening of the positioning element. Suitably, the angle is formed in one piece with the switch housing, with the free shank extending perpendicular to the central longitudinal axis of the switch housing and locking pin. As the positioning element includes an opening for the angle, the radial displacement of the positioning element is predetermined, and the positioning element is thus so coupled to the switch housing as to be captivated by the switch housing.

According to still another feature of the present invention, the safety member is a rib which is configured in the form of a fitting key, and the head portion includes a sleeve having a circumference formed with a plurality of grooves for selective engagement of the rib. Normally, the sleeve of the head portion is formed with four grooves extending in the direction of the central longitudinal axis of the switch housing. Suitably, the securement of the positioning element is effected by two screw fasteners, with the positioning being formed with two complementary threaded bores.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
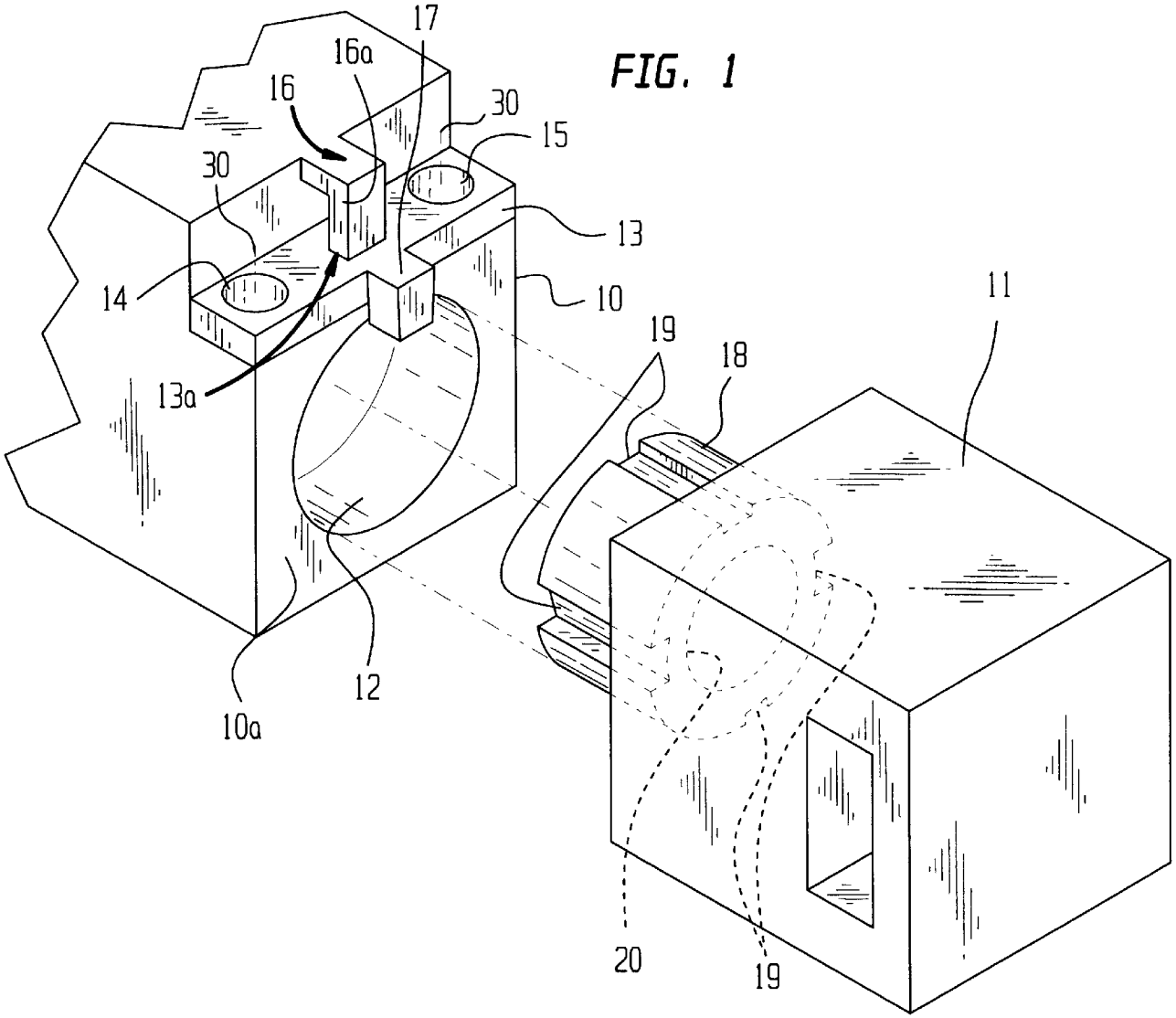
FIG. 1 is an exploded perspective view of a safety switch according to the present invention, illustrating a partially shown switch housing in conjunction with the head portion.

Throughout all the Figures, same or corresponding elements are generally indicated by same reference numerals.

Turning now to the drawing, and in particular to FIG. 1, there is shown an exploded perspective view of a safety switch according to the present invention, including a switch housing 10 and a head portion 11 for attachment to the switch housing 10. It will be appreciated by persons skilled in the art that the switch housing 10 and the head portion 11 must contain much mechanical, electrical or electronic apparatus which does not appear in the foregoing Figures. For example, the housing 10 accommodates a switch which is operated by means of plunger which is able to move in a longitudinal direction and cooperates with a switch wheel or cam plate placed within the head portion and operated by an actuator or key insertable into a key channel 11*a* of the head portion 11 for operation of the switch However, these elements, like much other necessary apparatus, is not part of the invention, and has been omitted from the Figures for the sake of simplicity.

On its end face 10*a* in opposition to the head portion 11, the housing 10 is formed with a bore 12 which defines a central longitudinal axis coinciding with the central longitudinal axis of the housing 10. The end face 10*a* is so shaped as to form a step-shaped configuration for placement of a flat positioning element 13 which is made of rigid material, preferably of steel. The positioning element 13 is formed with two threaded bores 14, 15 in spaced-apart relationship for threaded engagement of the positioning element 13 to the housing 10 by means of suitable screw fasteners 30, indicated only by dashdot lines, which engage in complementary bores of the switch housing 10. Projecting centrally outward from the end face 10*a* above the positioning element 13 is a guide element 16 in the form of an angle which has a free shank 16*a* extending perpendicular to the longitudinal axis of the bore 12 and closely fitting in a complementary opening 13*a* of the positioning element 13.

As further shown in FIG. 1, the positioning element 13 is provided with a safety member 17 in the form of a rib or fitting key which projects outward from the positioning element in direction of the head portion 11 and has a free area extending into the region of the bore 12.

The head portion 11 is formed on its side confronting the end face 10*a* of the housing 10 with a sleeve 18 which is securely mounted to or formed in one piece with the head portion 11. Formed about the perimeter of the sleeve 18 are four grooves 19 which are spaced from one another at an angle of 90° and extending in direction of the central longitudinal axis of the sleeve 18 or bore 12. The sleeve 18 may, as shown in FIG. 1, also be formed with a central bore 20.

Figure 2:
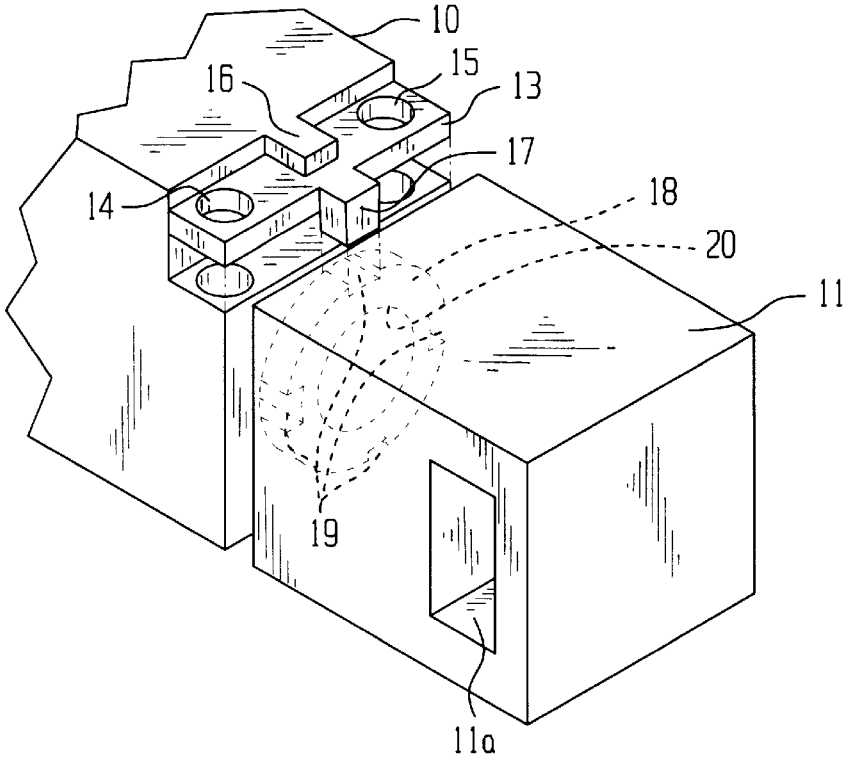
FIG. 2 is a perspective view of the safety switch, illustrating the head portion in close proximity of the switch housing, with the positioning element still being disengaged from the head portion.
Figure 3:
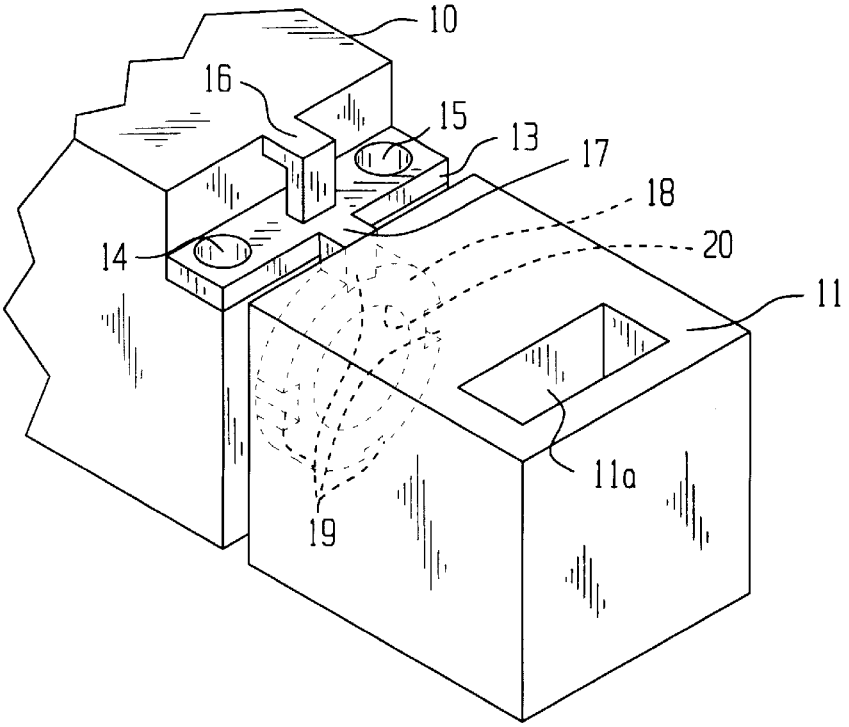
FIG. 3 is a perspective view of the safety switch in assembled state, with the positioning element in engagement with the head portion, shown in a 90° rotated position with respect to FIG. 2.

The safety member 17 and the grooves 19 so complement one another that the head portion 11 can be attached to the housing 10 in four different 90° rotated positions, with the safety member 17 closely fitting in the selected one of the grooves 19, as shown in FIGS. 2 and 3. FIG. 2 shows a disposition of the head portion 11, in which the key channel 11*a* for entry of an actuating element (not shown) faces sideways and the safety member 17 is still disengaged from the opposing groove 19, while FIG. 3 shows a 90° rotated position of the head portion 11 in which the key channel 11*a* faces upwards, whereby the key channel 11*a* extends transversely to the longitudinal axis of the sleeve 18. As a consequence of the interacting safety member 17 and grooves 19, a positive engagement is effected between the housing 10 and the head portion 11 in any one of the four positions of the head portion 11 with respect to the housing 10.

The head portion 11 can thus be attached to the housing 10 in four different positions to enable variations in the position of installation of the safety switch. For effecting a positional change of the head portion 11 with respect to the housing 10, the screw fasteners 30 are loosened to such an extent as to allow a radial shift of the positioning element 13 along the shank of the screw fasteners 30 and a disengagement of the safety member 17 from the groove 19, as shown in FIG. 2. These screw fasteners 30 remain however captivated in the bore 14, 15 to prevent loss thereof during disengagement of the safety member 17. The head portion 11 can now be turned unimpeded in both directions, with the angle 16 preventing a disengagement or separation of the positioning element 13 from the housing 10.

Figure 4:
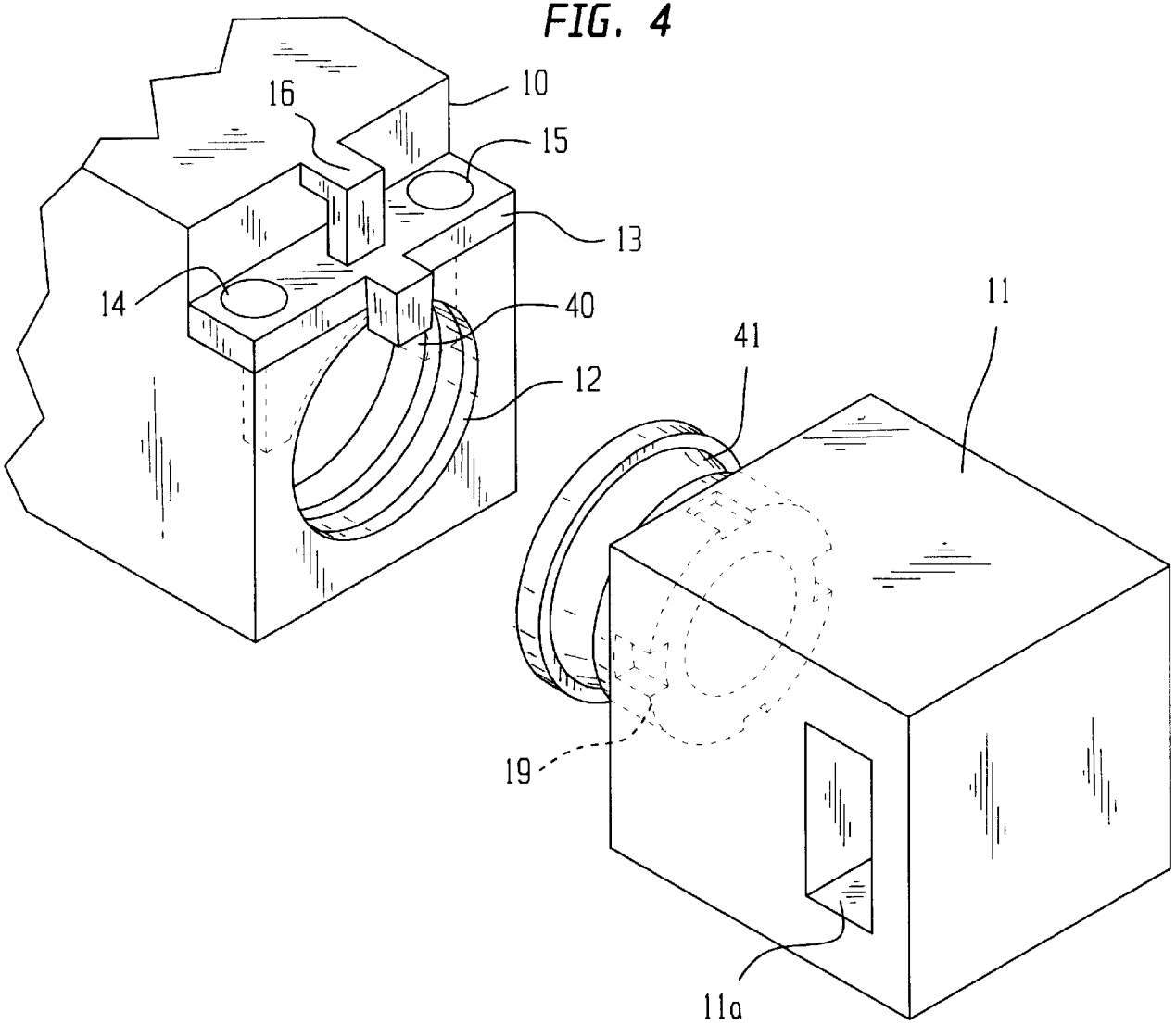
FIG. 4 is an exploded perspective view of a modified safety switch according to the present invention, illustrating an exemplified rotative connection between the switch housing and the head portion.

Persons skilled in the art will understand that the head portion 11 must be additionally connected to the housing 10 in a manner that allows the rotation of the head portion 11 into one of the four positions with respect to the housing 10 while preventing a displacement of the head portion 10 in axial direction relative to the housing 11 and thus a disengagement thereof from the housing 10 during readjustment of the head portion 11. An example of such a connection is shown in FIG. 4, with the housing 10 being formed interiorly in the bore 12 with a U-shaped bracket 40 which snugly fits in a circumferential groove 41 of the sleeve 18. Thus, the head portion 11 can be rotated when releasing the positioning element 13, without being disengaged in axial direction from the housing 10.

While the invention has been illustrated and described as embodied in a safety switch, it is not intended to be limited to the details shown since various modifications and structural changes may be made without departing in any way from the spirit of the present invention.

What is claimed as new and desired to be protected by Letters Patent is set forth in the appended claims:

1. A safety switch, comprising:

a switch housing;

a head portion securable to an end face of the switch housing in several predetermined angular positions;

a rigid positioning element detachably fixed to the switch housing and formed with a safety member, said positioning element being adjustable between a locked position in which the safety member is positively engaged in the head portion and a detached position in which the safety member is disengaged from the head portion for permitting the head portion to be turned relative to the switch housing.

2. The safety switch of claim 1 wherein the switch housing defines a longitudinal axis and is provided with a guide element for guiding the positioning element during a displacement in radial direction with respect to the longitudinal axis of the switch housing.

3. The safety switch of claim 2 wherein the switch housing has a side confronting the head portion, said guide element being connected to said side of the switch housing for engagement in a complementary bore of the positioning element.

4. The safety switch of claim 3 wherein the guide element is formed as angle.

5. The safety switch of claim 1 wherein the positioning element has threaded bores for engagement of fasteners for attachment of the positioning element to the switch housing.

6. The safety switch of claim 1 wherein the safety member is a rib designed in the form of a fitting key, said head portion including a sleeve having an outer perimeter formed with a plurality of grooves for selective engagement of the safety member.

7. The safety switch of claim 6 wherein the head portion has an end face in opposition to the switch housing, said sleeve projecting out from the end face of the head portion and formed with four grooves spaced about the circumference of the sleeve at an angle of 90° relative to one another.

8. A safety switch, comprising:

a switch housing defined by a longitudinal axis and including a switch;

a head portion having actuating means for interaction with the switch;

connecting means for securing the head portion to an end face of the switch housing such that the head portion is capable of being rotated relative to the housing but not displaceable in a direction of the longitudinal axis; and locking means for selectively securing the head portion in one of a plurality of predetermined angular positions with respect to the switch housing, said locking means including a rigid positioning element detachably fixed to the switch housing and formed with a safety member, said positioning element being adjustable between a locked position in which the safety member is positively engaged in the head portion and a detached position in which the safety member is disengaged from the head portion for permitting the head portion to be turned relative to the switch housing.

9. The safety switch of claim 8 wherein the locking means includes a guide element extending outward from a head portion confronting side of the switch housing for engagement in a complementary bore of the positioning element and guidance of the positioning element during a displacement in radial direction with respect to the longitudinal axis of the switch housing.

10. The safety switch of claim 9 wherein the guide element is formed as angle.

11. The safety switch of claim 8 wherein the locking means includes a screw fastener for engagement in aligned bores of the positioning element and the switch housing, said screw being captivated in the bore of the switch housing to prevent a loss thereof when the positioning element is in the detached position.

12. The safety switch of claim 8 wherein the safety member is a rib designed in the form of a fitting key, said head portion including a sleeve having an outer perimeter formed with a plurality of grooves for selective engagement of the safety member and thereby allow selective securement of the head portion in one of the plurality of predetermined angular positions with respect to the switch housing.

13. The safety switch of claim 12 wherein the head portion is formed with four grooves spaced about the circumference of the sleeve at an angle of 90° relative to one another.

* * * * *

UNITED STATES PATENT AND TRADEMARK OFFICE

CERTIFICATE OF CORRECTION

PATENT NO. : 5,929,404

DATED : July 27, 1999

INVENTOR(S) : Rolf Wecke, Joachim Ulfik & Meinhard Gerner

It is certified that error appears in the above-identified patent and that said Letters Patent is hereby corrected as shown below:

On the title page: Item

[75] Inventors: line 2, change "Viotho" to --Vlotho--

Signed and Sealed this

Thirtieth Day of January, 2001

*Attest:*

Q. TODD DICKINSON

*Attesting Officer*

*Director of Patents and Trademarks*